United States Patent [19]

Jung et al.

[11] Patent Number: 4,547,089

[45] Date of Patent: Oct. 15, 1985

[54] GUIDE FOR A PRINT HEAD OF A PRINTING DEVICE

[75] Inventors: Werner Jung, Morton Grove; Alfred Z. Purzycki, Arlington Heights, both of Ill.

[73] Assignee: AT&T Teletype Corporation, Skokie, Ill.

[21] Appl. No.: 524,519

[22] Filed: Aug. 19, 1983

[51] Int. Cl.[4] ..... B41J 19/30

[52] U.S. Cl. ..... 400/354; 400/352

[58] Field of Search ..... 400/320, 354, 352, 354.1, 400/354.2

[56] References Cited

U.S. PATENT DOCUMENTS

| | | | |
|---|---|---|---|
| 724,772 | 4/1903 | Alexander | 400/354.2 X |
| 1,448,217 | 3/1923 | Helmond | 400/354.2 |
| 3,987,882 | 10/1976 | Kobryn | 197/1 R |
| 4,145,145 | 3/1979 | Haubrich et al. | 400/124 |
| 4,173,273 | 11/1979 | Hanakata | 400/320 X |
| 4,257,282 | 3/1981 | Wilczewski et al. | 400/320 X |
| 4,300,847 | 11/1981 | Hoffman et al. | 400/320 X |
| 4,338,035 | 7/1982 | Kondo et al. | 400/320 X |
| 4,349,285 | 9/1982 | Gernelle | 400/320 |
| 4,362,406 | 12/1982 | Choberka et al. | 400/320 X |
| 4,396,305 | 8/1983 | Shattuck et al. | 400/320 X |
| 4,431,321 | 2/1984 | Trimble | 400/320 X |

FOREIGN PATENT DOCUMENTS

| | | | |
|---|---|---|---|
| 0016995 | 10/1980 | European Pat. Off. | 400/320 |
| 3115416 | 11/1982 | Fed. Rep. of Germany | 400/320 |
| 8101638 | 9/1981 | United Kingdom | 400/320 |

OTHER PUBLICATIONS

IBM Tech. Disc. Bulletin, Hampson, R. A., "Reciprocating Magnetic Stripe Reader", vol. 25, No. 7B, Dec. 1982, pp. 4003–4004.

IBM Tech. Disc. Bulletin, Petrovick, J. M., "Mechanical Parts Traveling Along Dual Parallel Shafts," vol. 26, No. 11, Apr. 1984, pp. 6067–6068.

*Primary Examiner*—Edgar S. Burr
*Assistant Examiner*—James R. McDaniel
*Attorney, Agent, or Firm*—A. A. Tirva

[57] ABSTRACT

A guide for directing a print head in a printing device parallel to a platen, the guide being constructed of a unitary extrusion of a metallic material having two guide rails joined by a thin web of material. The structural arrangement of the guide offers a high resistance against bending so that a constant predetermined distance can be maintained between the print head and the platen.

1 Claim, 2 Drawing Figures

GUIDE FOR A PRINT HEAD OF A PRINTING DEVICE

DESCRIPTION

1. Technical Field

This invention relates to a printing device with a movable print head and more particularly to a guide to direct the movement of a printing head parallel to the printing direction in the printing device.

2. Background Art

A printing device having one or more movable print heads usually requires at least a pair of guide rods to provide linear guiding for the print heads. When the printing devices are capable of printing more than 80 columns, such guide rods can be comparatively long. The guide rods are usually secured to end plates of the printing device which plates extend transversely to the rods. The end plates position the guide rods, and the guide rods when fastened to the end plates lock the end plates together providing structural rigidity to the frame formed by the end plates and the guide rods.

Guide rods impose a problem in that a compromise must be found between construction of a printer having a comparatively low weight, a high resistance against bending by the rods and maximum rigidity of the entire printer structure. Bending may be due to the weight of the printing head itself, as well as, to reaction forces on the guide rails. These reaction forces occur when a printing head utilizes mechanical impact elements such as printing wires in a dot matrix printer. Bending of the guide rods causes curved lines on a record medium as well as differences in contrast of the characters printed. Differences in contrast of this kind are caused by the non-constant distance between the ends of the printing wires and the record medium. The parallel relationship of the guide rods to the record medium is therefore essential. Additional pending forces acting on the guide rods are encountered due to rapid lateral acceleration and deceleration of the print head.

DISCLOSURE OF THE INVENTION

In accordance with the present invention, we provide a guide for the lateral displacement of the carriage upon which a print head is mounted. The guide consists of a unitary extrusion of a metallic material having two parallel guide rails joined by a thin web of the material.

THE DRAWING

DETAILED DESCRIPTION

Figure 1:
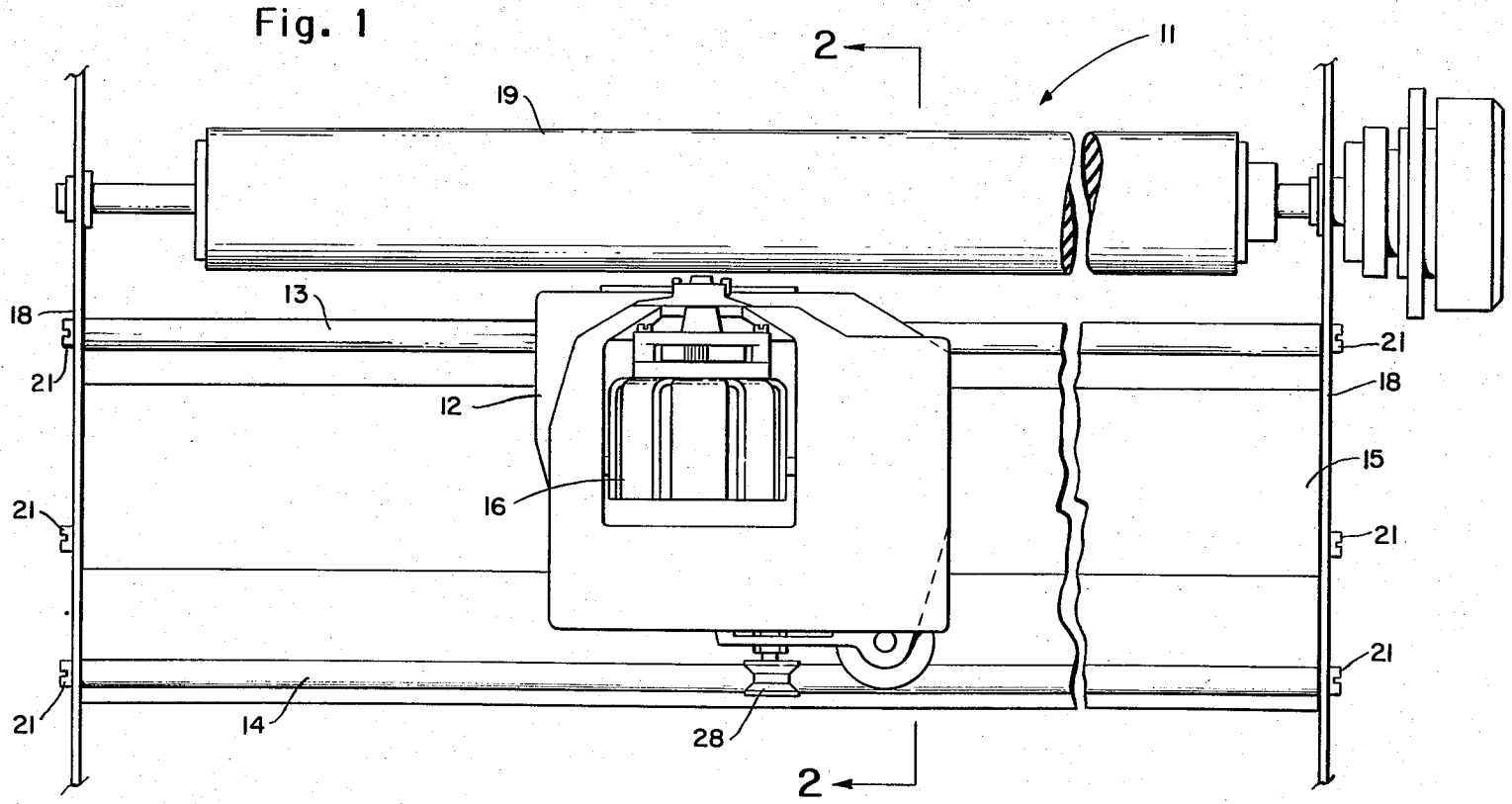
FIG. 1 shows a partial top view of the printing device in accordance with the invention.

FIG. 1 shows a partial top view of a printing device 11 having a print head 16 mounted on a carriage 12. A platen 19 for supporting a record medium (not shown) is rotatably mounted between end panels 18. The print head 16 includes a plurality of print wires (not shown) each wire having one end connected to an actuator (not shown) which when energized causes the wire to move forward. The free ends of the wires are aligned in a vertical line and are positioned close to the platen 19.

Figure 2:
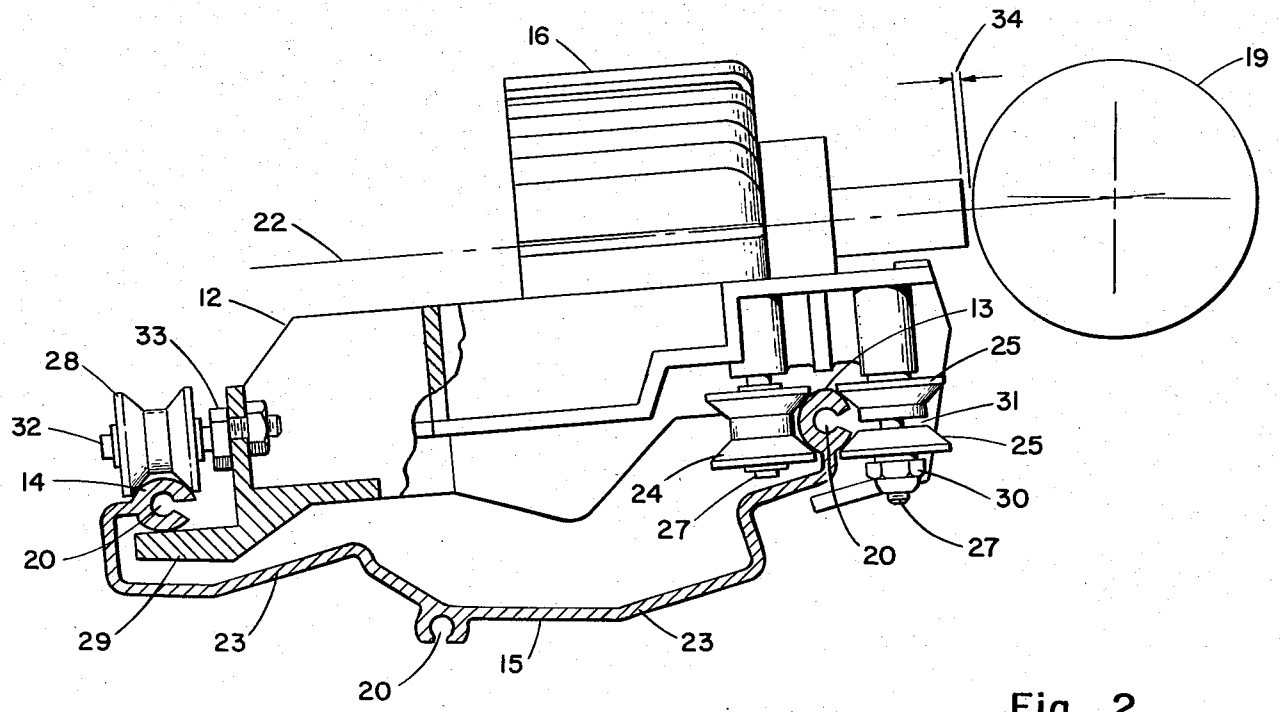
FIG. 2 shows a cross-sectional view of the printing device shown in FIG. 1.

Referring now to FIGS. 1 and 2, the carriage 12 is slidably mounted on a guide 15 which has two parallel guide rails 13 and 14 for supporting and directing the carriage 12 parallel to the platen 19. The guide rails 13 and 14 orient the carriage 12 so that an imaginary line 22 which coincides with the center line of the print head 16 is perpendicular to the path of travel of the carriage 12 and intersects the center line of the platen 19. Line 22 is referred to as the line of printing.

The guide 15 is constructed of a one-piece extrusion of a metallic material such as aluminum or magnesium and consists of the guide rails 13 and 14 connected by a thin web 23 of substantially uniform thickness. The web 23 has a modified U channel shape which gives the guide 15 structural and torsional rigidity. Each end of the guide 15 has a plurality of openings 20 adapted to receive screws 21. In the assembly of the printing device 11 the guide 15 is positioned between the two end panels 18 and is fastened to the end panels 18 with screws 21. The guide 15 and end panels 18 form a box-like structure which provides structural and torsional rigidity to the printing device 11. Guide rails 13 and 14 have elliptical cross sections and when the guide 15 is located in the printing device 11 the major axes of the cross sections of guide rails 13 and 14 are positioned perpendicular and parallel, respectively, to the line of printing 22 of the print head 16.

Two sets of sheaves, each set consisting of a solid sheave 24 and a split sheave 25, only one set is shown in FIG. 2, are rotatably mounted on shafts 27 extending from the bottom surface of the carriage 12. The shafts 27 are positioned so as to align the axes of rotation of the sheaves 24 and 25 perpendicular to the line of printing 22 while the sheaves 24 and 25 engage guide rail 13.

A sheave 28, is rotatably mounted on a shaft 32 on the back portion of the carriage 12. The sheave 28 is mounted so that its axis of rotation is parallel to the line of printing 22. The sheave 28 rides on top of the guide rail 14 and is maintained on top of the guide rail 14 by a sliding retaining arm 29 which extends from the back portion of the carriage 12 and engages the bottom surface of the guide rail 14. The shaft 32 has one end fastened to an eccentrically adjustable surface 33 adjustment which either raises or lowers the shaft 32 with respect to the guide rail 14 and thus either decreases or increases the pressure between the sheave 28 and the guide rail 14.

Each split sheave 25 consists of two equal halves which are slidably mounted on shaft 27 and are retained on the shaft 27 by adjustable nuts 30, only one of which is shown in FIG. 2. When the halves of the sheave 25 are in engagement with the guide rail 13, as shown in FIG. 2, movement of the nut 30 in or out along the shaft 27 varies a gap 31 between the two halves of the sheave 25. The variation of the gap 31 is translated to a movement of the carriage along a line parallel to the line of printing 22 permitting limited adjustment of a distance 34 between the ends of the printing wires and the platen as well as compensating for any wear of the sheaves 24 and 25.

What is claimed is:

1. A printing device for printing on a line on the record medium supported by a platen, the device comprising:

a print head, a carriage for supporting the print head, a unitary one piece guide comprising:

first and second parallel guide rails for supporting and guiding the carriage, each guide rail having a substantially elliptical cross-section, the major axes of the two cross-sections being substantially perpendicular to each other, a web of substantially uniform thickness and having a substantially U-shaped cross-section joining the two guide rails, first and second opposite rotatably mounted sheaves located on the carriage, the sheaves having their axes of rotation substantially perpendicular to the center line of the print head and arranged to engage the first guide rail, the first sheave having two individually mounted halves, means for varying the distance between the two individually mounted halves of the first sheave parallel to the axis of rotation of the sheave, a third sheave rotatably mounted on the carriage having its axis of rotation substantially parallel to the center line of the print head and arranged to engage the second guide rail, and, means for varying the position of the third sheave along a line substantially perpendicular to the axis of rotation of the sheave.

* * * * *